US007695253B2

(12) United States Patent
Yang

(10) Patent No.: US 7,695,253 B2
(45) Date of Patent: Apr. 13, 2010

(54) MAGNETIC DISPLACEMENT PUMP AND COMPRESSOR

(75) Inventor: Wei Yang, Minnetonka, MN (US)

(73) Assignee: Honeywell International Inc., Morristown, NJ (US)

( * ) Notice: Subject to any disclaimer, the term of this patent is extended or adjusted under 35 U.S.C. 154(b) by 525 days.

(21) Appl. No.: 11/656,832

(22) Filed: Jan. 23, 2007

(65) Prior Publication Data

US 2008/0175721 A1 Jul. 24, 2008

(51) Int. Cl.
*F04B 35/00* (2006.01)

(52) U.S. Cl. ..... 417/322; 417/417

(58) Field of Classification Search ..... 417/322, 417/416, 417, 418
See application file for complete search history.

(56) References Cited

U.S. PATENT DOCUMENTS 461,295 A * 10/1891 Van Depoele ..... 417/418
2,515,110 A 7/1950 Bornstein ..... 230/55
2,557,634 A * 6/1951 Cox ..... 401/182
2006/0008367 A1* 1/2006 Yokozawa et al. ..... 417/418
2007/0237658 A1* 10/2007 Burns et al. ..... 417/417

FOREIGN PATENT DOCUMENTS

DE 3046048 A1 8/1992
EP 0106414 A2 4/1984

OTHER PUBLICATIONS

PCT—Notification of Transmittal of The International Search Report and The Written Opinion of the International Searching Authority, or t Declaration, Date of Mailing: Feb. 6, 2008.

* cited by examiner

*Primary Examiner*—Devon C Kramer
*Assistant Examiner*—Bryan Lettman
(74) *Attorney, Agent, or Firm*—Kris T. Fredrick; Kermit D. Lopez; Luis M. Ortiz

(57) ABSTRACT

A device for pumping and compressing fluids, particularly in micro-liter quantities. First and second polarized cylindrical magnets are mounted in a cylinder with an inlet and an outlet port. The first magnet is adapted to rotate on the axis of the cylinder and has a fixed longitudinal position on that axis. The second magnet is free to move longitudinally but kept from any rotational movement, as a piston in the cylinder. The inlet port is open when the piston magnet is repelled by the rotor magnet's polarity and the outlet is open when the piston magnet is attracted by the rotor magnet's polarity as it rotates.

17 Claims, 3 Drawing Sheets

MAGNETIC DISPLACEMENT PUMP AND COMPRESSOR

FIELD OF THE INVENTION

The present invention relates to field fluid pumping in micro-liter scale. More particularly, the present invention relates to a device for fluid pumping and compressing using diametrically polarized cylindrical magnets.

BACKGROUND OF THF INVENTION

Fluid pumping or compression in micro-liter scale is critical for a variety of micro instrumentation applications, including chip-scale chromatography and mass spectroscopy. It is also a key component in micro-refrigeration systems for electronic cooling. In the past decade, various micro/meso pumps have been developed based on electrostatic actuation, but so far have not demonstrated sufficient single-stage pressure head or vacuum levels for these applications. For example, to achieve the highly desirable <76 torr vacuum for chip-scale ion trap mass spectrometers (ITMS), multi-stage configuration is necessary but limited by volume constraint.

Current micropumps are even less adequate for refrigeration (i.e. heat pump), where pressure differential of several bars are needed. On the other hand, conventional and macro scale mechanical pump designs are extremely difficult to implement in microscales, due to their complex configuration, difficulty in valve fabrication, friction, and leakage issues.

Accordingly, one advantage of the present invention is to provide a micropump or compressor that has higher pressure and increased flow capacity when compared to diaphragm pumps.

Another advantage of the present invention is to provide a pump that is feasible for microscale implementation.

Yet another advantage of this invention is that has a valveless design and built-in timing.

Still another advantage of this invention is to provide a micropump that requires no special drive electronics, thus reducing the cost of the device.

Other advantages will appear hereinafter.

SUMMARY OF THE INVENTION

It has now been discovered that the above and other advantages of the present invention may be obtained in the following manner. In its simplest form, the present invention includes at least two diametrically polarized cylindrical magnets in a cylinder so that one magnet functions as a rotor and rotates about the axis of the cylinder and the other magnet functions as a piston and moves along the axis of the cylinder.

The first magnet is fixedly mounted in the cylinder to prevent movement axially and is free to rotate when, for example, a shaft is attached to its other side and rotational forces are applied to rotate the polarity about the axis. The second magnet is free to move axially and will be attracted to or repelled by the magnetic forces between them, depending upon the relative rotational orientation of the rotor magnet.

An inlet port is also provided in the cylinder to permit fluids to be pulled into the space between the two magnets when the polarity forces the magnets apart. Similarly, an outlet port is provided in the cylinder to permit fluids in the space to be expelled when the polarity of the magnets causes them to attract each other.

In a preferred embodiment, at least a portion of the outer cylinder in which the magnets are held is also magnetized such that its polarity opposes the polarity of the piston magnet to further restrain rotational movement thereof.

In yet another preferred embodiment, a third diametrically polarized cylindrical rotor magnet is positioned above the piston magnet, with the polarity of the three magnets being aligned to add the forces of attraction and repulsion. Optionally a second inlet port and outlet port can be provided for the second rotor magnet.

BRIEF DESCRIPTION OF THE DRAWINGS

For a more complete understanding of the invention, reference is hereby made to the drawings, wherein like numbers refer to like elements, and in which.

DETAILED DESCRIPTION OF THE PREFERRED EMBODIMENT

Figure 1A:
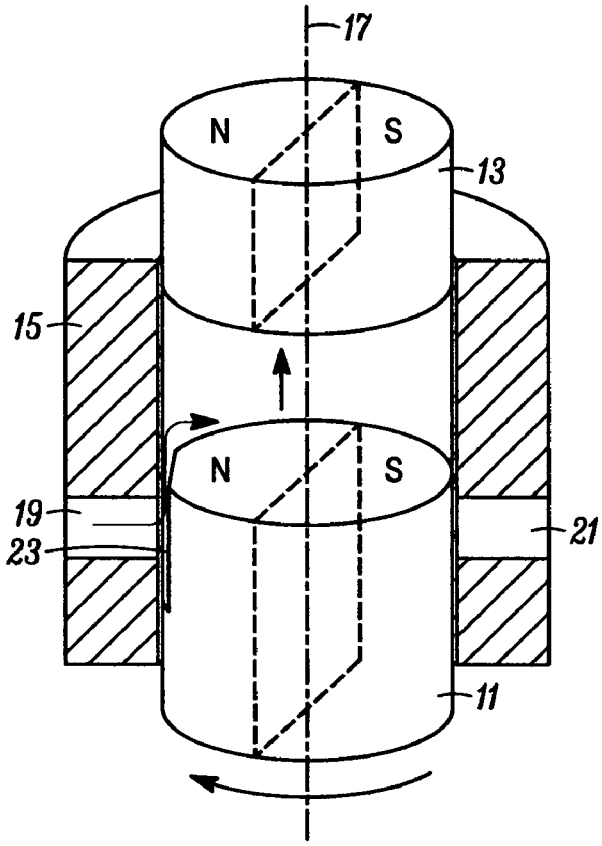
FIGS. 1*a* and 1*b* are perspective views of one embodiment of this invention in which the outer cylinder is shown in section and the inner cylindrical magnets are shown in magnetic attraction and repulsion conditions.
Figure 1B:
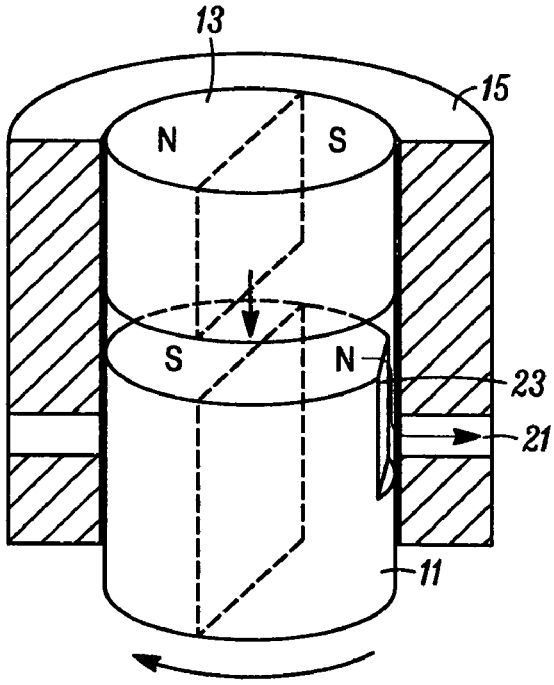

The present invention comprises a novel device for pumping fluids using the forces of magnetic attraction and repulsion. As shown in FIGS. 1*a* & 1*b*, the device, 10 generally includes a first diametrically polarized cylindrical magnet 11 and a second diametrically polarized cylindrical magnet 13 mounted in a cylinder 15 having an axis 17. Cylinder 15 has an inlet port 19 and an outlet port 21.

Magnet 11 functions as a rotor magnet and is free to rotate about axis 17 but is restrained from movement up or down axis 17. Magnet 13 functions as a piston magnet and is free to move up or down axis 17 but is restrained from movement about axis 17.

As shown in FIG. 1, the polarity of magnets 11 and 13 is illustrated by N and S, referring of course to north and south polarity of the magnets. When the polarities of the two magnets 11 and 13 are aligned such that N faces N, the piston magnet is repelled by the combined magnetic forces of the magnets 11 and 13. When they are aligned such that N faces S, the magnets attract each other.

When the magnets are repelled, fluid from a source, not shown, enters inlet port 19 as shown on the left view of FIG. 1 by the arrow as piston 13 magnet moves away from rotor magnet 11. On the right view of FIG. 1, piston magnet 13 is pulled toward rotor magnet 11 and fluid is expelled through outlet port 21 to a destination, not shown. Rotor magnet 11 has an area 23 on its side that has been removed to permit fluid to flow in from inlet port 19 as shown on the left view and through outlet port 21 as shown in the right view.

Rotor magnet 11 can be rotated by a crank or other mechanical device attached to its outer side, The speed of rotation and the frequency will depend on the end use of the device of this invention.

Optionally, rotor magnet 11 can be rotated by an external coil in a manner similar to a brushless motor.

Figure 2A:
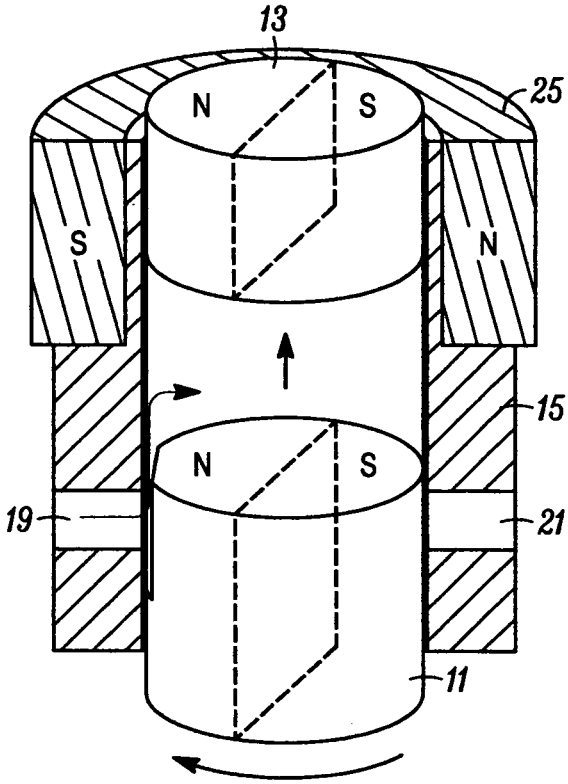
FIGS. 2*a* and 2*b* are similar perspective views of another embodiment of this invention in which at least a portion of the outer cylinder is also formed from magnetic material.
Figure 2B:
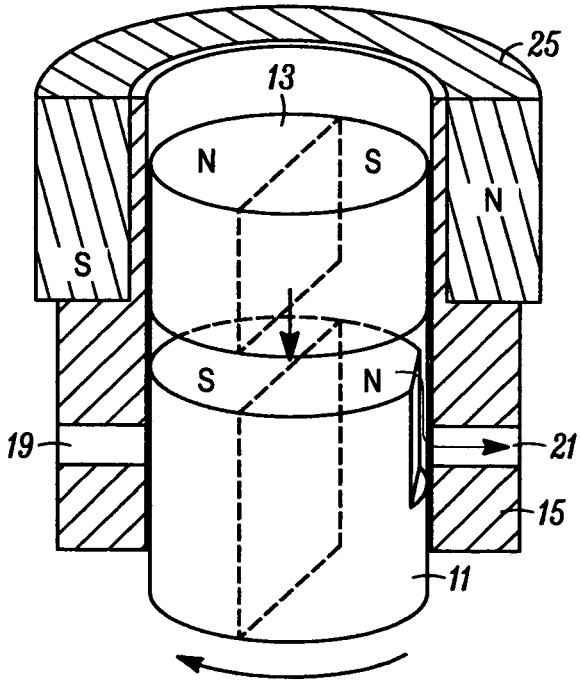

FIG. 2 illustrates a preferred embodiment in which the cylinder 15 further includes an external magnet 25 on its outside, with the N and S polarity of external magnet 25 aligned to piston magnet 13, thus preventing rotational movement of piston magnet 13 about axis 17. This embodiment functions the same as that embodiment shown in FIG. 1.

Figure 3:
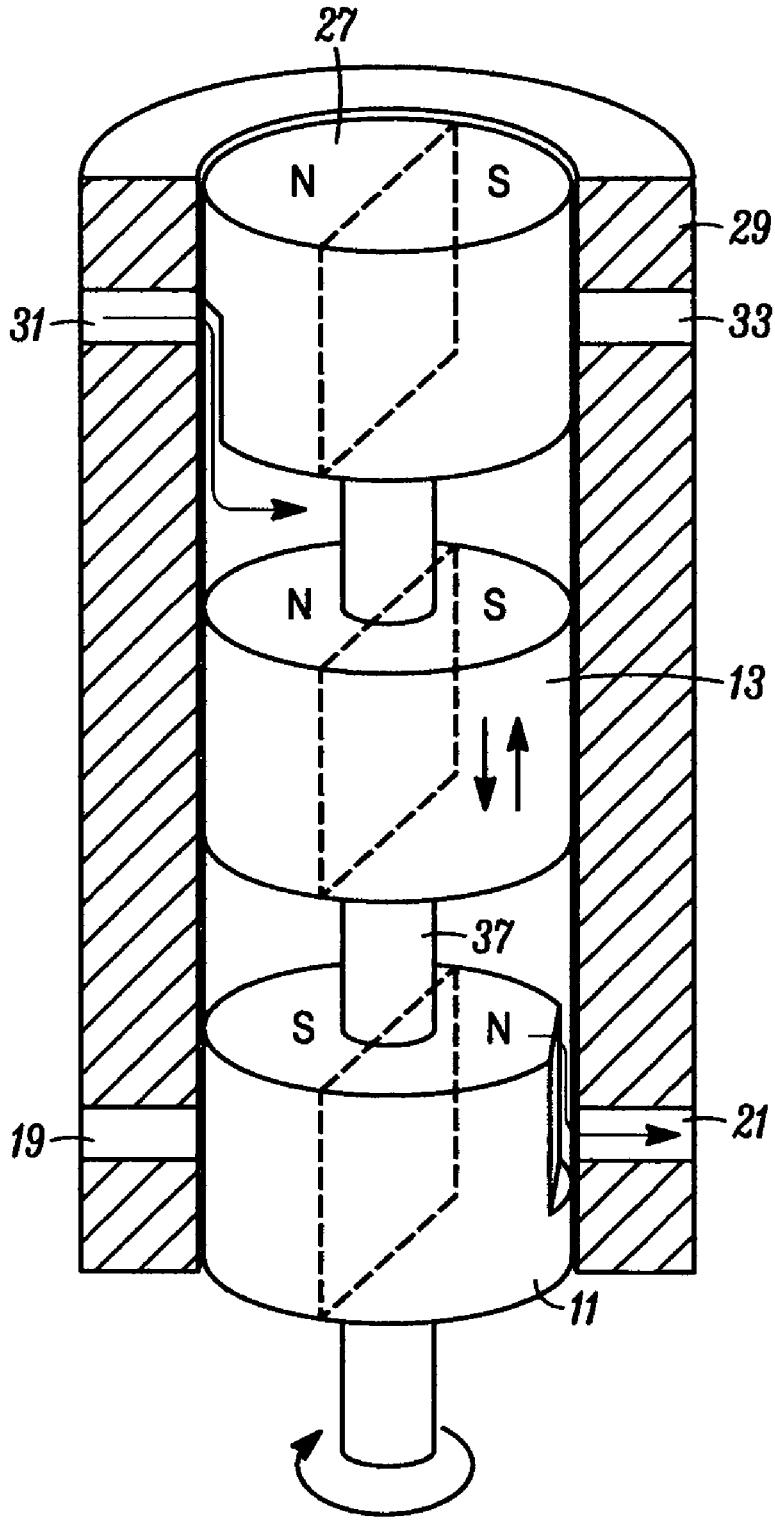
FIG. 3 is a similar perspective view of yet another embodiment in which a second rotor magnetic cylinder is shown on the other side of the piston cylinder.

FIG. 3 illustrates a preferred embodiment in which a second rotor magnet 27 is placed in an enlarged cylinder 29. The polarity of this second rotor magnet is opposite to that of first rotor magnet 11 so that both rotor magnets act on the piston magnet 13 in the same direction. Both rotor magnets 11 and 27 are mounted on a common shaft 37. The piston magnet 13 is free to slide axially along shaft 37. Cylinder 29 also has a second inlet port 31 and outlet port 33 for simultaneous pumping, compressing or other fluid transfer, although only one set of ports is needed for the device to function, using the second rotor magnet 27 increases the magnetic attraction and repulsion. This embodiment has the advantage of push-pull double action with two pump cycles per rotation, and thus has twice the pump speed compared to the devices of FIG. 1 or 2 at the same stroke length.

This invention is admirably suited for use with products involving fluid transport, particularly moving fluids against substantial pressures. The invention is also useful for generating and maintaining vacuum or compression or pressurization of fluids. These applications are commonly encountered in refrigeration, cooling, power conversion, chromatography, mass spectrometry, and other instrumentation needs. Because of its valve-less design and simplicity, this invention is particularly suitable for implementation in micro scales.

While particular embodiments of the present invention have been illustrated and described, it is not intended to limit the invention, except as defined by the following claims.

The invention claimed is:

1. A device for pumping and compressing fluids, comprising:

first and second diametrically polarized cylindrical magnets such that the respective polarities attract or repel depending on the relative position thereof;

a cylinder having an axis mounting said first and second polarized cylindrical magnets, said magnets facing each other and being centered on said cylinder axis;

an inlet port and an outlet port in said cylinder;

said first magnet being a rotor magnet adapted to rotate on said axis of said cylinder and fixedly restrained on a longitudinal position on said axis;

said second magnet being a piston magnet adapted to move longitudinally along said axis in said cylinder toward or away from said rotor magnet, said piston magnet being kept from rotational movement;

said inlet port being positioned to be open when said piston magnet is repelled by the mutual polarity of said magnets and closed when said piston magnet is attracted by the mutual polarity of said magnets as said rotor magnet rotates; and said outlet port is positioned to be open when said piston magnet is attracted by the mutual polarity of said magnets as said rotor magnet rotates and closed when said piston magnet is repelled by the mutual polarity of said magnets, wherein said rotor magnet includes a flat or groove on its cylindrical surface for communicating with said inlet port and said outlet port.

2. The device of claim 1, wherein said cylinder further includes a magnetized portion aligned such that it's polarity opposes the polarity of said piston magnet.

3. The device of claim 1, wherein said device further includes a second diametrically polarized cylindrical rotor magnet positioned in said cylinder on the opposite side of said piston magnet from said rotor magnet, said second rotor magnet being free to rotate about said axis and restrained from movement along said axis.

4. The device of claim 3, wherein the polarity of said rotor magnet, said piston magnet and said second rotor magnet are aligned to add the forces of attraction and repulsion.

5. The device of claim 4, which further includes a second inlet port and second outlet port positioned to introduce and expel fluids between said piston magnet and said second rotor magnet.

6. The device of claim 5, wherein said second inlet port is open when said outlet port is open and said second outlet port is open when said inlet port is open.

7. The device of claim 1, wherein said first magnet includes a coil positioned for causing rotation of said first magnet.

8. A device for pumping and compressing fluids, comprising:

first and second diametrically polarized cylindrical magnet means for movement when the respective polarities attract or repel depending on the relative position thereof;

cylinder means having an axis for mounting said first and second polarized cylindrical magnet means, said magnet means facing each other and being centered on said cylinder means axis;

inlet port means and outlet port means in said cylinder for introducing and expelling fluids between said magnet means;

said first magnet means being a rotor magnet means for rotation on said axis of said cylinder means and fixedly restrained on a longitudinal position on said axis;

said second magnet means being a piston magnet means for movement longitudinally along said axis in said cylinder toward or away from said rotor magnet, said piston magnet being kept from rotational movement;

said inlet port means being positioned to be open when said piston magnet means is repelled by the mutual polarity of said magnet means and closed when said piston magnet is attracted by the mutual polarity of said magnets as said rotor magnet rotates; and said outlet port means is positioned to be open when said piston magnet is attracted by the mutual polarity of said magnet means as said rotor magnet means rotates and closed when said piston magnet is repelled by the mutual polarity of said magnets, wherein said rotor magnet means includes a flat or groove on its cylindrical surface for communicating with said inlet port means and said outlet port means.

9. The device of claim 8, wherein said cylinder means further includes a magnetized portion aligned such that it's polarity opposes the polarity of said piston magnet means.

10. The device of claim 8, wherein said device further includes a second diametrically polarized cylindrical rotor magnet means positioned in said cylinder for rotation about said axis and restrained from movement along said axis, said second rotor magnet means being positioned on the opposite side of said piston magnet means from said rotor magnet means.

11. The device of claim 10, wherein the polarity of said rotor magnet means, said piston magnet means and said second rotor magnet means are aligned to add the forces of attraction and repulsion.

12. The device of claim 11, which further includes a second inlet port and second outlet port positioned to introduce and expel fluids between said piston magnet and said second rotor magnet.

13. The device of claim 12, wherein said second inlet port and second outlet port operate in a push-pull action.

14. The device of claim 8, wherein said first magnet means includes a coil means for causing rotation of said first magnet means.

15. A method for pumping and compressing fluids, comprising the steps of:

positioning first and second diametrically polarized cylindrical magnets in a cylinder having an axis such that the respective polarities attract or repel depending on the relative position thereof on said axis, said first magnet being a rotor magnet for rotation about said axis and said second magnet being a piston magnet for movement along said axis;

connecting an inlet port in said cylinder to a source of fluid to be pumped and connecting an outlet port in said cylinder to a receptacle for said fluid;

rotating said rotor magnet on said axis of said cylinder while fixedly restraining said rotor magnet on a longitudinal position on said axis;

rotating said rotor magnet to cause said second piston magnet to move longitudinally along said axis in said cylinder toward or away from said rotor magnet;

opening said inlet port source and closing said outlet port when said piston magnet is repelled by the mutual polarity of said magnets to draw fluid from said source; and opening said outlet port and closing said inlet port when said piston magnet is attracted by the mutual polarity of said magnets as said rotor magnet rotates to expel fluid into said receptacle, wherein said rotor magnet includes a flat or groove on its cylindrical surface for communicating with said inlet port and said outlet port.

16. The method of claim 15, wherein said cylinder further includes a magnetized portion aligned such that it's polarity opposes the polarity of said piston magnet.

17. The method of claim 15, wherein said first magnet is rotated by a coil positioned for causing rotation of said first magnet.

* * * * *